US006696950B2

(12) United States Patent
Adolphson

(10) Patent No.: US 6,696,950 B2
(45) Date of Patent: Feb. 24, 2004

(54) GOLF BAG ALARM

(76) Inventor: C. Thomas Adolphson, 6052 S. Don Carlos Dr., Taylorsville, UT (US) 84118

( * ) Notice: Subject to any disclaimer, the term of this patent is extended or adjusted under 35 U.S.C. 154(b) by 9 days.

(21) Appl. No.: 09/974,830

(22) Filed: Oct. 12, 2001

(65) Prior Publication Data

US 2003/0071729 A1 Apr. 17, 2003

(51) Int. Cl.[7] ..... G08B 13/14

(52) U.S. Cl. ..... 340/568.6; 340/571; 340/572; 206/315.3; 206/315.6

(58) Field of Search ..... 340/568.6, 571, 340/568, 280, 572; 206/315.6, 315.3

(56) References Cited

U.S. PATENT DOCUMENTS 4,042,918 A 8/1977 Klitzman
4,489,314 A 12/1984 Miller
5,028,909 A 7/1991 Miller
5,041,815 A 8/1991 Newton
5,493,274 A 2/1996 Long
5,870,023 A 2/1999 Jackson
5,877,686 A 3/1999 Ibey et al.
5,952,921 A * 9/1999 Donnelly ..... 340/568.6
5,973,596 A 10/1999 French et al.
6,057,762 A * 5/2000 Dusza ..... 340/568.6
6,181,246 B1 * 1/2001 Ewing et al. ..... 340/571

FOREIGN PATENT DOCUMENTS

GB 2334801 9/1999
WO 00/19930 4/2000

* cited by examiner

*Primary Examiner*—Jeffery Hofsass
*Assistant Examiner*—Lam P Pham
(74) *Attorney, Agent, or Firm*—Richard C. Litman

(57) ABSTRACT

A golf bag alarm provides notification of the lifting or moving of a golf bag, to the owner thereof who may be remotely located from the bag. The alarm includes a golf bag component which may be semi-permanently installed upon an existing golf bag, or permanently, integrally installed with a golf bag during bag manufacture. The golf bag component includes a weight actuated switch, an alarm transmitter, a receiver for remotely arming the alarm, and may also include an audio or visual alarm. The second component is carried by the golfer, and includes a transmitter for remotely arming and disarming the alarm system of the golf bag unit, a receiver for detecting an alarm signal from the golf bag unit, and an alarm. The system is valuable for the golfer who must leave his/her bag outside while visiting a golf clubhouse, course restaurant, etc.

6 Claims, 5 Drawing Sheets

GOLF BAG ALARM

BACKGROUND OF THE INVENTION

1. Field of the Invention

The present invention relates generally to alarms and notification systems, and more particularly to an alarm system for alerting the owner of a golf bag that the bag has been moved or taken. The present alarm activates a remote unit carried by the golfer, to notify the golfer if the remotely located bag has been moved or taken. The remote unit includes means for remotely arming the alarm.

2. Description of the Related Art

Golf has become an increasingly popular game throughout the world, with many golfers spending a considerable sum on equipment. Aside from the cost of the equipment, many golfers have favorite clubs, bags, and/or other accessories which they feel help their game, and/or have been customized in some way, and/or to which the golfer has become attached. The loss of such golf equipment goes beyond the monetary value, as the emotional cost of losing one or more pieces of equipment which is associated with pleasant memories, e.g. a round of golf at a famous course, or a putter used to sink an important putt, etc., can be quite high.

Yet, it is customary at most courses and clubs for golfers to leave their equipment unattended for some periods of time, due to the rules at those locations. For example, it is customary at most courses and clubs for golfers to be required to leave their equipment outside the clubhouse, when they enter. The same is generally true of the club or course restaurant and pro shop. Golfers generally leave their bags and equipment reasonably close to the door when entering such establishments, but the equipment is still unattended, with the owner being removed at some distance from the equipment.

While most people are honest and would not think of deliberately taking another person's golf equipment under such circumstances, mistakes are occasionally made, with a golfer picking up someone else's equipment which has a resemblance to his or her own equipment. While generally no great harm is done, the result can be disastrous if the bag and clubs are inadvertently taken by someone who lives far away and is just visiting the area, and travels some great distance before realizing his or her error. While intentional theft is rare, it can occur, and the thief is likely to take the clubs and bag to some other area well removed from the site of the theft, in order to sell them. Thus, the golfer whose equipment is taken, either intentionally or unintentionally, may have a very difficult time in having the equipment returned, if the golfer is ever able to recapture the equipment at all.

Accordingly, a need will be seen for a golf bag alarm which alerts the owner of the golf equipment, when the bag and equipment are remotely located from the owner and the bag is moved or taken. The present alarm comprises two basic components. The first component is secured to the bottom of the golf bag, or integrated with the golf bag structure at the time of manufacture of the bag. This first component comprises a power source (electrical cell, etc.), receiver, alarm actuator, and transmitter. The second component comprises a small, key fob type alarm unit, similar to those used with vehicle alarms. The user of the system arms the alarm on the bottom of the golf bag by using the remote alarm unit. If the bag is lifted, the alarm actuator contacts are closed to activate the transmitter at the bag. The remote alarm unit carried by the golfer is actuated by the transmitted signal, to notify the golfer that the bag has been lifted or moved.

A discussion of the related art of which the present inventor is aware, and its differences and distinctions from the present invention, is provided below.

U.S. Pat. No. 4,042,918 issued on Aug. 16, 1977 to Charles B. Klitzman, titled "Apparatus Indicating An Absent Golf Club," describes a device installed in the top of a golf bag and having a series of individual passages for each club shaft. A sensor is actuated whenever a club is removed, to activate an alarm. The device serves as a reminder to the golfer to replace any club(s) removed, but does nothing to alert the owner of the equipment if the entire bag is moved with all clubs in place.

U.S. Pat. No. 4,489,314 issued on Dec. 18, 1984 to Sheldon M. Miller, titled "Golf Club Monitor," describes another system for alerting the golfer when one or more clubs are not replaced within the bag. The Miller system also requires special receptacles for each club, and depends upon the magnetic permeability or electrical conductivity of the metal shafts of the clubs for operation, or a metallic coating on the club shafts. However, Miller does not provide any means of detecting when the entire golf bag is moved or lifted, as provided by the present golf bag alarm invention. A person could take the entire bag equipped with the Miller club alarm system, with all clubs in place, without activating the Miller alarm.

U.S. Pat. No. 5,028,909 issued on Jul. 2, 1991 to Robert A. Miller, titled "Golf Bag Alarm," describes yet another system for alerting a golfer when one or more clubs have been removed from a golf bag and have not been replaced. As in the other devices discussed to this point, the Miller system does nothing to alert a golfer that the entire bag has been lifted or moved.

U.S. Pat. No. 5,041,815 issued on Aug. 20, 1991 to Ross E. Newton, titled "Golf Bag Security Alarm System," describes various embodiments of such an alarm system. In one embodiment, the alarm is installed in the bottom of the golf bag and is actuated when the weight of the bag is lifted to close the alarm contacts. However, Newton does not utilize any remote components or subsystems with his bag alarm system, as is done in the present invention. The Newton audible alarm is located with the remainder of the alarm system, at or in the golf bag (or in a golf cart, in other embodiments), rather than being located with the owner of the golf bag at all times. Thus, if the owner of the bag is some distance away (e.g., in the clubhouse, etc.) he or she may not even hear the alarm at the golf bag if it is picked up or moved. Moreover, the Newton system requires that the alarm be armed by actuating a switch at the bag (or golf cart, in that embodiment). The present alarm utilizes remote actuation technology, as is incorporated in automobile alarm systems.

U.S. Pat. No. 5,493,274 issued on Feb. 20, 1996 to Richard P. Long, titled "Golf Bag Alarm," describes a portable alarm device resembling a golf club, but including a housing along the shaft for one or more electrical cells or batteries. The simulated club head includes a motion sensor and audible alarm unit. If the simulated club, or the bag in which the simulated club is installed, is moved, the motion sensor detects the movement and actuates the alarm. Long also provides for remote arming of the alarm, as he notes is used conventionally e.g. in automobile alarm systems. However, Long fails to provide any means of sending a signal from the alarm system installed in the golf bag, to a remote unit carried by the golfer. The remote unit provided with the Long system, serves only to arm the golf bag alarm and cannot detect any signals if the alarm is actuated, as provided by the present alarm system. Moreover, the Long system does little to deter a thief, as the thief can quickly and easily discard the simulated club with its audible alarm and take the rest of the bag.

U.S. Pat. No. 5,870,023 issued on Feb. 9, 1999 to Gerald L. Jackson, titled "Golf Bag Alarm," describes a portable alarm device removably placeable in a golf bag pocket. A series of lanyards connect each club (or club head cover) to the alarm, with another lanyard extending from the alarm for removable connection to another object. If any of the club head covers are removed sufficiently to pull its lanyard, or if the alarm attachment lanyard is pulled sufficiently, the alarm is sounded. The Jackson device thus relies upon having an anchor point for attachment of the alarm lanyard, in order to prevent theft of the entire bag. In contrast, the present system utilizes only the weight of the bag, and is directed toward prevention of the taking of the entire bag and its contents, rather than only to individual clubs. Moreover, Jackson does not disclose any remote arming or alarm signalling.

U.S. Pat. No. 5,877,686 issued on Mar. 2, 1999 to Jerry A. Ibey et al., titled "Golf Bag Theft Protection System," describes a portable device, removably placeable within a pocket of a golf bag. The Ibey et al. device is not immovably affixed to the bag, either as a permanent or semi-permanent installation, as is the golf bag component of the present alarm system. Ibey et al. recognize the importance of providing a remote alarm in a unit carried by the golfer when he/she is away from the golf bag, but they do not address remote actuation of the bag alarm unit, as provided by the present invention. Moreover, the Ibey et al. system is actuated by a tilt detection device, rather than by the weight of the golf bag, as in the present invention.

U.S. Pat. No. 5,973,596 issued on Oct. 26, 1999 to John R. French et al., titled "Golf Club And Bag Security System," describes various embodiments, including an alarm system providing an alert if the entire golf bag is moved. The French et al. system operates on a different principle than that used with the present invention, i.e., French et al. use an electromagnetic inductance loop to detect displacement of the bag, while the present system uses a much simpler, less costly, and more reliable switch placed on the bottom of the bag, which closes when the bag is picked up. Moreover, French et al. do not disclose any form of remote device for their alarm, and cannot arm their alarm remotely or transmit an alarm signal to a remote unit, as provided by the present golf bag alarm invention.

British Patent Publication No. 2,334,801 published on Sep. 1, 1999 to Philip H. Gazeley, titled "Alarm Device For Use With A Golf Bag," describes a temporarily attachable alarm device having a cable which wraps around the clubs, or in another embodiment, utilizes an electromagnetic inductance principle. The Gazeley device differs considerably from the present alarm, in that the Gazeley unit attaches only temporarily to the bag, with no permanent installation being possible. Moreover, Gazeley does not provide any means of remotely arming his alarm, nor of sending an alarm signal to a remote unit, as provided by the present invention. Finally, Gazeley utilizes a different principle of actuation than the weight actuated switch used with the present golf club alarm invention.

Finally, PCT Publication No. 00/19,390 published on Apr. 6, 2000 to Susan M. Jackson et al., titled "Alarm System For Forgotten Golf Club," describes a system wherein a radio transmitter is installed in a divot repair tool. The golfer carries a receiver tuned to the divot tool transmitter. When the golfer places a club on the ground (or wherever), he/she must place the divot tool transmitter near the club. So long as the receiver carried by the golfer receives a sufficiently strong signal from the divot tool transmitter, i.e., the receiver is within a predetermined range of the transmitter, the alarm is not triggered. However, if the golfer leaves the area with the divot tool transmitter and the club remaining behind, the receiver senses the weakened signal and activates an alarm. This system differs considerably from the present system, in that the present system does not require that the golfer remember to place a separate transmitter unit with a club, or to remember to pick up the separate transmitter unit when retrieving the club. Rather, the present system protects the entire golf bag and club collection from inadvertent taking or theft, without further action on the part of the owner, other than initially arming the alarm transmitter contained within or beneath the golf bag.

None of the above inventions and patents, taken either singularly or in combination, is seen to describe the instant invention as claimed. Thus a golf bag alarm solving the aforementioned problems is desired.

SUMMARY OF THE INVENTION

The present invention is a golf bag alarm, with different embodiments providing for semi-permanent or permanent integral installation to or in the bottom of a golf bag. The present golf bag alarm provides a remote alarm for a golfer who has left his or her clubs at a location somewhat separated from the golfer, as frequently occurs when the golfer visits the clubhouse, course restaurant or bar, restroom, etc.

The present alarm essentially comprises two components. The first or golf bag component includes a weight sensitive switch, which closes when the bag is lifted from the ground or other underlying surface. A transmitter is actuated by closure of the switch, to send a signal to a remotely located receiver carried by the golfer. The golf bag component may also include an alarm which is actuated at the golf bag, if so desired.

The second component is an alarm annunciator and control, which is carried by the golfer and includes a transmitter and receiver. The golfer actuates the golf bag alarm and transmitter remotely by means of the second component transmitter. If the golf bag is picked up, the weight activated switch is closed, thereby triggering an alarm signal at the golf bag. The receiver carried by the golfer receives the transmitted alarm signal, and provides an alarm (audio, vibratory, etc.) to the golfer to alert him or her that the golf bag has been moved.

Accordingly, it is a principal object of the invention to provide a golf bag alarm, for alerting a golfer that his or her golf bag has been moved or taken.

It is another object of the invention to provide such a golf bag alarm including a weight sensitive switch beneath the bag for activating a transmitter therewith, for sending an alarm signal to a remotely located receiver and alarm annunciator unit.

It is a further object of the invention to provide such a golf bag alarm including an actuating receiver at the golf bag unit, and an actuating transmitter at the remotely located alarm annunciator unit, whereby the golf bag alarm unit may be remotely actuated and deactivated by means of the alarm annunciator unit.

Still another object of the invention is to provide such a golf bag alarm including a semi-permanently installed embodiment for installation to an existing golf bag, and further including a permanently installed embodiment integrally formed with the golf bag at the time of manufacture, with each embodiment further alternatively including an alarm at the golf bag, if so desired.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises a golf bag alarm system, for alerting a golfer who is away from his or her golf bag for whatever reason, in the event that another party moves or takes the golfer's bag and clubs, whether intentionally or inadvertently. The situation where a golfer is separated from his or her equipment occurs frequently in golfing, when the golfer visits the clubhouse, course restaurant, restroom, etc., where carrying his or her equipment into the facility may not be practicable or allowed.

Figure 1:
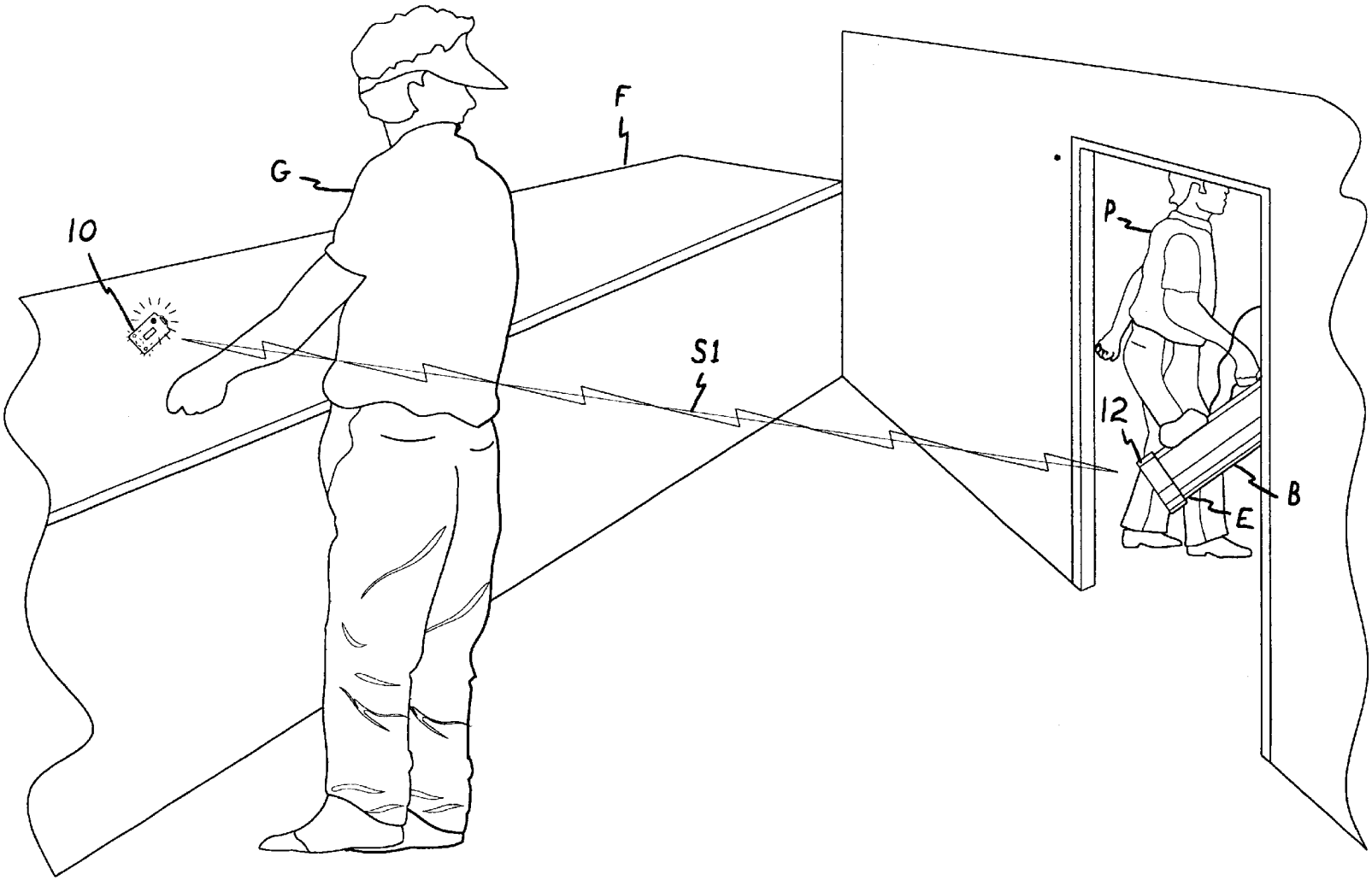
FIG. 1 is an environmental, perspective view of a golf bag alarm according to the present invention, showing the activation of the annunciator component when the golf bag is moved.

FIG. 1 of the drawings illustrates a potential scenario where the present golf bag alarm invention will prove valuable. In FIG. 1, a golfer G has left his golf bag B at the exterior of the facility F (clubhouse, pro shop, etc.) which he is visiting. Another party P has begun to remove the golfer G's bag B from its resting place just outside the doorway. The golf bag B includes at least a golf bag mounted switch and transmitter (indicated in the block diagram of FIG. 5). Lifting the bag B from the underlying surface (ground, sidewalk, etc.) closes the golf bag mounted switch of the present alarm system, causing the golf bag mounted transmitter to send a signal S1 to a remotely carried receiver and alarm unit 10, which is carried by the golfer G. The receiver of the alarm unit 10 activates an alarm in the unit, thereby notifying the golfer that his golf bag B has been lifted or moved by another party P.

Figure 2:
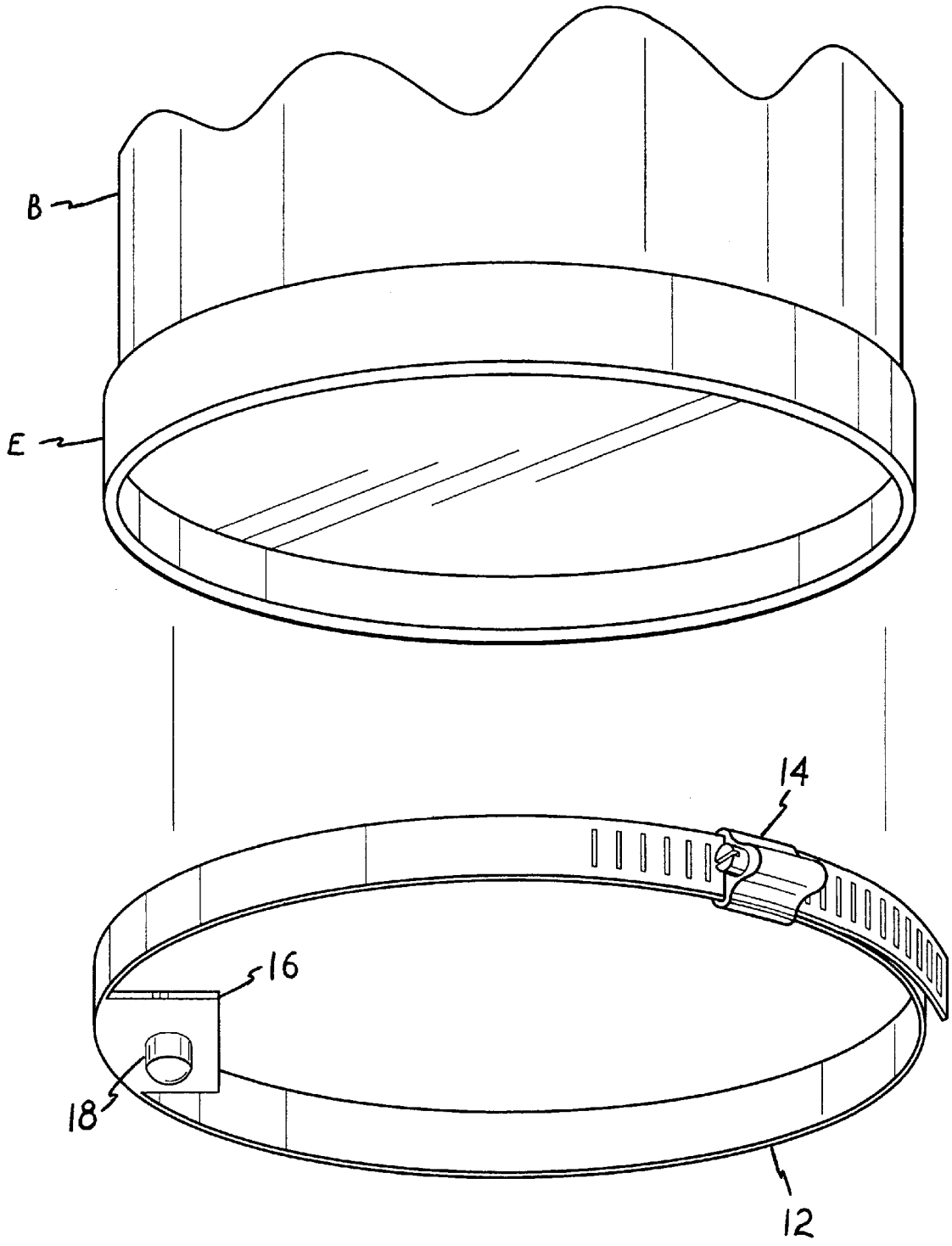
FIG. 2 is an exploded and fragmented perspective view of the bottom of a golf bag and bag installation component of the present invention, illustrating their assembly.

The golf bag mounted alarm unit may be secured to or provided with the golf bag in different ways. In the embodiment of FIGS. 1 and 2, a removable, retrofit assembly for attachment to an existing golf bag G is illustrated. A circumferential golf bag alarm attachment ring 12 is immovably affixed about the circumferential bottom or lower end E of the golf bag B. The alarm attachment ring 12 may have a generally conventional hose clamp configuration with a worm screw adjustment mechanism 14, shown in FIG. 2, as is known in the art. A plate or extension 16 extends inwardly from the ring 12 to hold the various golf bag attached components of the present invention, shown in block diagram form in FIG. 5.

A normally closed, pushbutton switch 18 extends from the bag alarm mounting plate 16 and below the bottom of the golf bag B, with placement of the bag B on an underlying surface causing the weight of the bag B to retract the button of the switch 18 and open the switch contacts. This opens the circuit for the alarm transmitter, thus assuring that the alarm cannot be activated so long as the golf bag B is resting with its lower end E upon some underlying surface. Such switches are well known in the motor vehicle field, and are used to activate interior lights and alarms when vehicle doors or other panels are opened.

Figure 3:
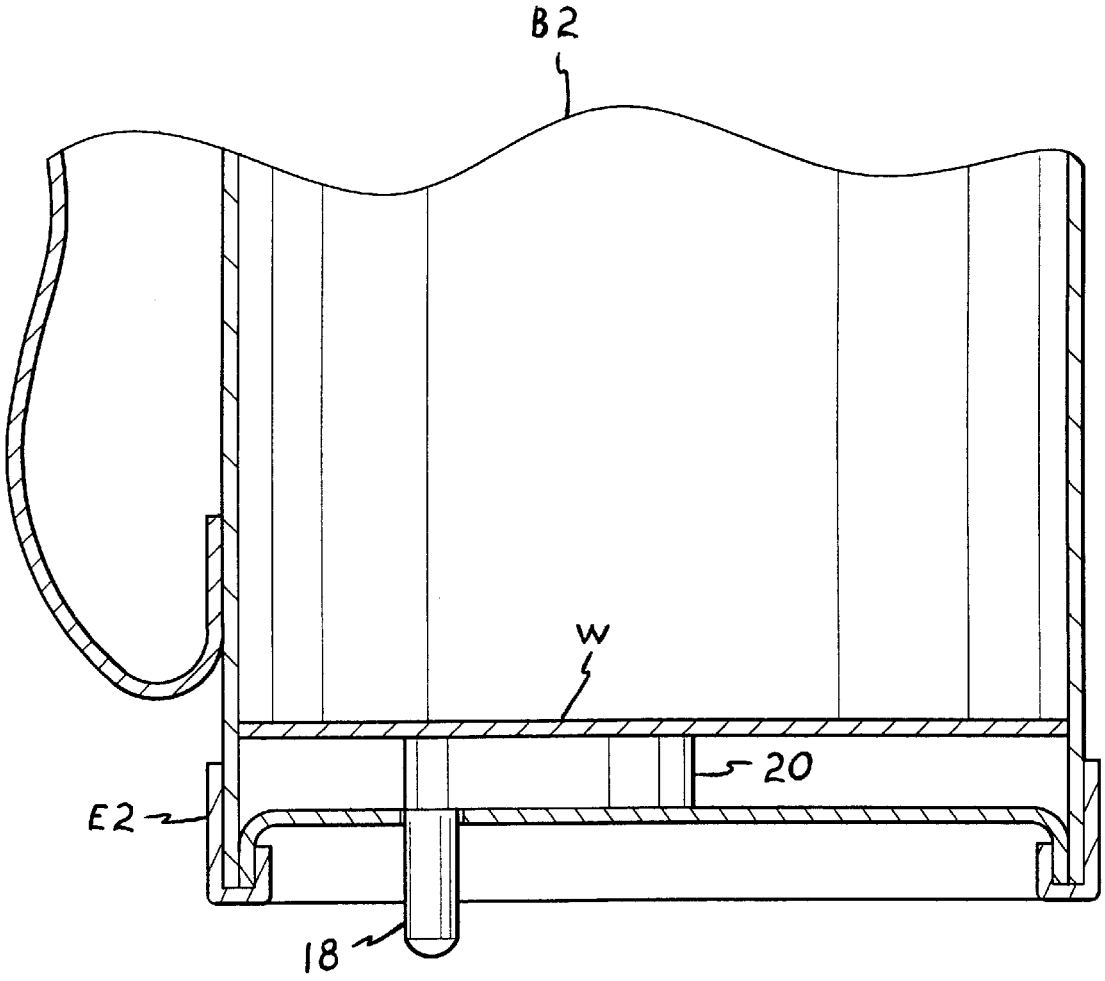
FIG. 3 is a fragmented side elevation view in section of a golf bag incorporating a permanently and integrally installed embodiment of the present golf bag alarm invention.

FIG. 3 illustrates an elevation view in section of a golf bag B2 incorporating an alternate embodiment of the present invention, wherein the bag components of the present alarm are permanently installed in the lower end E2 of the bag B2. The bag installed components, i.e., alarm transmitter, actuating receiver, etc. of FIG. 3 are installed within a housing or case 20, which is in turn installed in a volume within the lower end E2 of the bag B2 beneath a protective panel or wall W at the time the bag is manufactured. Access is provided only for routine maintenance such as changing the electrical cell(s) or battery by removing the protective panel or wall W from time to time as required. The alarm assembly and case 20 are not normally accessible, particularly when clubs are placed within the bag B2. However, a normally closed pushbutton switch 18, essentially the same as the switch 18 of the first embodiment of FIG. 2, extends beneath the bag B2 and operates in the same manner as that described for the FIGS. 1 and 2 embodiment.

Figure 4:
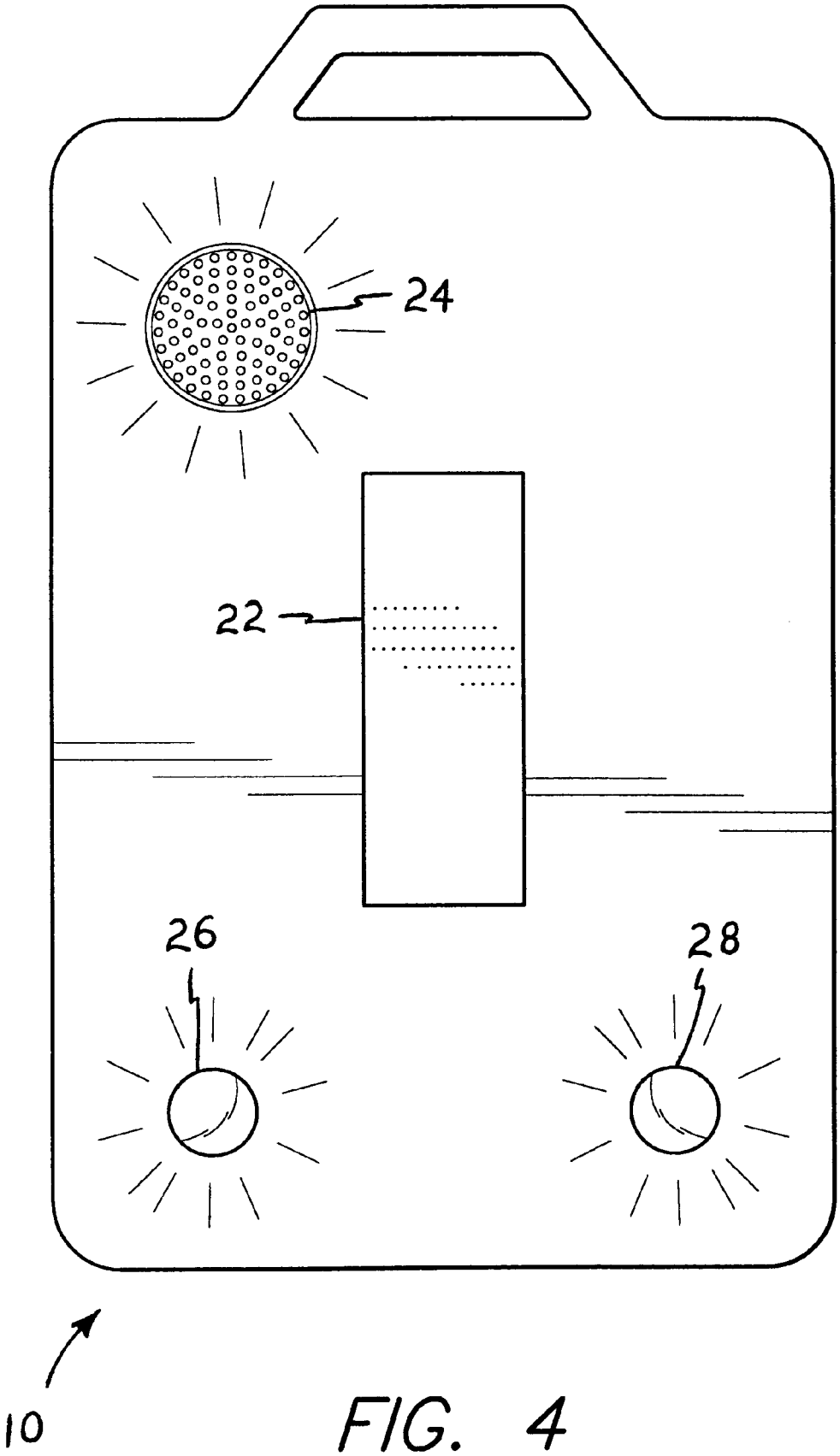
FIG. 4 is a top plan view of the face of the annunciator and control unit for the present alarm, showing its features.

FIG. 4 provides a top plan view of the remote alarm receiver unit 10, carried by the golfer using the present invention. The remote unit 10 may be in the form of a flat card carried on a key chain, or other configuration as desired. The use of state of the art microminiaturized components, and the low power required due to the low range requirements of the present alarm system, allow the componentry and power supply to be placed within an extremely compact package, as is known in the art. The remote unit 10 includes an on/off switch 22, which may be a membrane type "toggle" type switch (i.e., alternating on-off actuation with each alternate contact), or other type of switch, as desired. An audio alarm annunciator 24 is provided with the unit 10, as is a visual alarm indicator 26, e.g., an LED which flashes when the alarm is triggered. A second "alarm armed" light 28 may also be provided.

Figure 5:
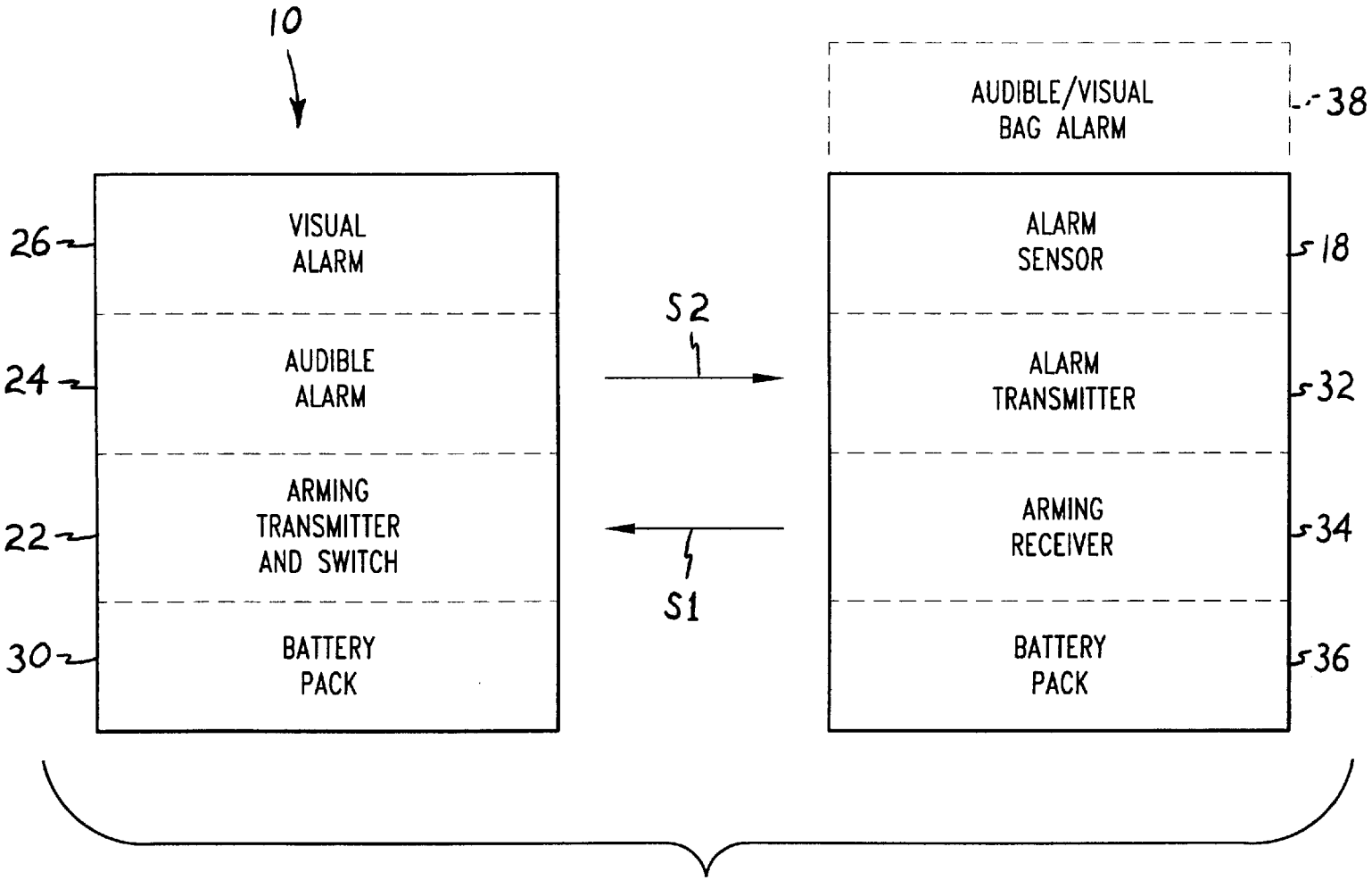
FIG. 5 is a block diagram showing the basic components of the bag installed and golfer carried components of the present alarm.

FIG. 5 is a block diagram of the componentry of the present invention. The left side of FIG. 5 represents the golfer carried remote alarm unit 10, including an arming switch and transmitter assembly 22 (and may further include an alarm status indicator light 28, shown in FIG. 4), an audible alarm 24, a visual alarm 26, and a power supply 30 (electrical storage cell or battery, etc.). The right side of FIG. 5 represents those components installed on or within the golf bag B, including an alarm sensor (e.g., the pushbutton switch 18 of FIGS. 2 and 3), an alarm transmitter 32, a receiver 34 for remotely arming the alarm system, and an electrical supply, e.g., battery pack 36. An audio alarm 38 may also be provided at the bag if so desired, but it is not required.

The present system operates much like a conventional remotely actuated car alarm or similar system, with the exception that a loud audio alarm is not required (however, it is optional) with the apparatus containing the alarm sensor, as is the case with the conventional car alarm system. When the golfer G leaves his or her golf bag B outside of a facility F, as shown in FIG. 1, the golfer arms the alarm unit by actuating the alarm arming transmitter switch 22 of the remotely carried alarm unit 10. This sends an arming or alarm actuation signal to the arming receiver 34 of the golf bag alarm unit, as shown by the arming signal arrow S2 in FIG. 5. The golfer then carries the remote unit with him or her as the golf bag G is left behind.

If the golf bag G is lifted or moved, as shown by the second party P in FIG. 1, the alarm actuator button or sensor 18 extends as the weight of the golf bag G is removed therefrom, thereby closing the switch to activate the alarm transmitter 32. The transmitter 32 sends an alarm signal S1 (indicated by the arrow in FIG. 5, and the signal line in FIG. 1) to the alarm receiver and audio alarm assembly 24 remotely carried by the golfer with the remote alarm unit 10. The optional audio and/or visual alarm 38 located at the golf bag B may be actuated simultaneously by the alarm switch 18, if the bag B is so equipped. The receiver and audio alarm 24 are actuated to alert the golfer that his or her equipment is being moved, as indicated in FIG. 1 of the drawings. A visual alarm 26 may be included with the audio alarm of the remote unit 10, if so desired.

At this point, the alerted golfer G need only return the few steps to the general location where the golf bag B was placed, to retrieve the golf bag B. As the present alarm system is intended only for relatively short ranges, e.g., no more than a hundred feet or so, the golfer G is easily able to retrieve his or her golf bag from another party, in a matter of seconds. However, without the present alarm, the golfer might not be aware for some time that his or her golf bag had been taken, with the party taking the golf bag being at a considerable distance from the golfer by the time the golfer realizes that his or her golf bag is gone.

In conclusion, the present golf bag alarm provides an extremely economical means for a golfer to keep track of his or her equipment when the golfer is required to place the equipment outside a facility frequented by the golfer. The present alarm system provides an essentially instantaneous notification to the golfer that his or her equipment has been moved, enabling the golfer to retrieve the equipment almost immediately. The cost of the conventional electronics used in the present golf bag alarm componentry, is considerably less than the cost of the typical golf bag and club set. Accordingly, the present golf bag alarm will prove to be an extremely valuable addition to virtually any set of golf equipment.

It is to be understood that the present invention is not limited to the embodiments described above, but encompasses any and all embodiments within the scope of the following claims.

I claim:

1. A golf bag alarm for a golf bag comprising:

a weight actuated golf bag alarm switch for installing upon a golf bag, said golf bag having a bottom circumference;

a golf bag transmitter for installing upon the golf bag and communicating with said golf bag alarm switch, for transmitting an alarm signal;

a golf bag receiver for installing upon the golf bag with said golf bag alarm switch and said golf bag transmitter, for receiving remotely transmitted signals for activating and deactivating said golf bag transmitter;

a remotely carried alarm receiver, for receiving the alarm signal transmitted by said golf bag transmitter;

alarm means disposed with said remotely carried alarm receiver, for notifying a person carrying said remotely carried alarm receiver of the reception of the alarm signal;

a remotely carried alarm transmitter disposed with said alarm receiver and said alarm means, for transmitting signals to activate and deactivate said golf bag transmitter; and a circumferential golf bag alarm attachment ring, for securing about the bottom circumference of the golf bag, said golf bag alarm switch, said golf bag transmitter, and said golf bag receiver each being secured to the golf bag by said golf bag alarm attachment ring.

2. The golf bag alarm according to claim 1, wherein said golf bag alarm switch, said golf bag transmitter, and said golf bag receiver are each immovably affixed to the golf bag.

3. The golf bag alarm according to claim 1, wherein the golf bag has a bottom, and wherein said golf bag alarm switch, said golf bag transmitter, and said golf bag receiver are each permanently and integrally disposed with the bottom of the golf bag.

4. The golf bag alarm according to claim 1, further including an alarm disposed with said golf bag alarm switch and said golf bag transmitter.

5. A golf bag alarm for a golf bag, comprising:

a weight actuated golf bag alarm switch;

a golf bag transmitter communicating with said golf bag alarm switch, for transmitting an alarm signal;

a golf bag receiver for receiving remotely transmitted signals to activate and deactivate said golf bag transmitter;

a circumferential golf bag alarm attachment ring for securing about a bottom circumference of the golf bag, said golf bag alarm switch, said golf bag transmitter, and said golf bag receiver each being securable to the golf bag by said golf bag alarm attachment ring;

a remotely carried alarm receiver for receiving the alarm signal transmitted by said golf bag transmitter;

alarm means disposed with said remotely carried alarm receiver, for notifying a person carrying said remotely carried alarm receiver of the reception of the alarm signal; and a remotely carried alarm transmitter disposed with said alarm receiver and said alarm means, for transmitting signals to activate and deactivate said golf bag transmitter.

6. The golf bag alarm according to claim 5, further including an alarm disposed with said golf bag alarm switch and said golf bag transmitter.

* * * * *